US007140196B2

(12) United States Patent
Pfeifer et al.

(10) Patent No.: US 7,140,196 B2
(45) Date of Patent: Nov. 28, 2006

(54) CHILLED BEVERAGE DISPENSER WITH CRADLE EVAPORATOR

(75) Inventors: Thomas J. Pfeifer, Louisville, KY (US); Thomas C. McDonald, Portland, OR (US)

(73) Assignee: Grindmaster Corporation, Louisville, KY (US)

( * ) Notice: Subject to any disclaimer, the term of this patent is extended or adjusted under 35 U.S.C. 154(b) by 0 days.

(21) Appl. No.: 11/194,213

(22) Filed: Aug. 1, 2005

(65) Prior Publication Data

US 2006/0112719 A1 Jun. 1, 2006

Related U.S. Application Data

(60) Provisional application No. 60/631,803, filed on Nov. 30, 2004.

(51) Int. Cl.
*B67D 5/62* (2006.01)

(52) U.S. Cl. ..... 62/394; 62/518; 222/146.6

(58) Field of Classification Search ..... 62/389, 62/394–395, 516–519; 222/146.6
See application file for complete search history.

(56) References Cited

U.S. PATENT DOCUMENTS

| | | | | |
|---|---|---|---|---|
| 2,745,261 | A | 5/1956 | Merrill | |
| 2,778,202 | A | 1/1957 | Fischer et al. | |
| 2,781,648 | A * | 2/1957 | Lyman | 62/394 |
| 2,784,565 | A | 3/1957 | Stalkup | |
| 3,108,449 | A | 10/1963 | Lents | |
| 3,180,110 | A | 4/1965 | Dunn | |
| 3,196,627 | A | 7/1965 | Swenson | |
| 3,312,083 | A * | 4/1967 | Scoggins et al. | 62/390 |
| 3,319,436 | A | 5/1967 | Wilch | |
| 3,370,755 | A * | 2/1968 | Querner | 222/146.6 |
| 3,386,261 | A * | 6/1968 | Cornelius | 62/339 |
| 3,400,551 | A | 9/1968 | Booth et al. | |
| 3,435,990 | A | 4/1969 | Pike, Jr. | |
| 3,495,612 | A * | 2/1970 | Learn et al. | 137/209 |
| 3,656,316 | A | 4/1972 | Stock | |
| 3,822,565 | A | 7/1974 | Arzberger | |
| 3,832,862 | A * | 9/1974 | Ingels | 62/227 |
| 3,958,428 | A | 5/1976 | Kelso | |
| 4,083,200 | A | 4/1978 | Luxem | |
| 4,124,994 | A | 11/1978 | Cornelius et al. | |
| 4,332,145 | A | 6/1982 | Yuhasz et al. | |
| 4,362,028 | A | 12/1982 | Armstrong | |
| 4,476,146 | A | 10/1984 | Manfroni | |
| 4,597,509 | A * | 7/1986 | Pereira | 222/129 |

(Continued)

OTHER PUBLICATIONS

ISA/US, PCT International Search Report and Written Opinion of the International Searching Authority for International Application No. PCT/US05/40767, Jun. 12, 2006, pp. 1-5.

*Primary Examiner*—William E. Tapolcai
(74) *Attorney, Agent, or Firm*—Stites & Harbison, PLLC; David W. Nagle, Jr.

(57) ABSTRACT

A chilled beverage dispenser has a "holeless" bowl and uses a cradle evaporator to achieve cooling of the beverage. In one exemplary embodiment, the cradle evaporator comprises three panels—a bottom panel and two side panels, the side panels being bolted or similarly fastened to the edges of the bottom panel in a substantially perpendicular orientation relative to the bottom panel. The bottom and side panels each define a continuous and sinuous channel, which carries a cooling medium. The dispenser bowl preferably is constructed of a thin-walled plastic, such that when the dispenser bowl is received in the cradle evaporator, heat transfer is achieved through the bottom wall and portions of the side walls of the bowl.

18 Claims, 7 Drawing Sheets

U.S. PATENT DOCUMENTS

| | | | |
|---|---|---|---|
| 4,653,281 | A | 3/1987 | Van Der Veer |
| 4,765,152 | A | 8/1988 | Armstrong |
| 4,869,072 | A | 9/1989 | Sexton et al. |
| 5,150,820 | A | 9/1992 | McGill |
| 5,201,861 | A | 4/1993 | Menzel |
| 5,361,941 | A | 11/1994 | Parekh et al. |
| 5,368,198 | A | 11/1994 | Goulet |
| 5,427,276 | A | 6/1995 | Knuettel, II et al. |
| 5,463,878 | A | 11/1995 | Parekh et al. |
| 5,537,838 | A | 7/1996 | Mills et al. |
| 5,692,392 | A | 12/1997 | Swier |
| 6,082,123 | A | 7/2000 | Johnson |
| 6,093,312 | A | 7/2000 | Boulter |
| 6,119,472 | A | 9/2000 | Ross |
| 6,213,007 | B1 | 4/2001 | Lande |
| 6,220,047 | B1 | 4/2001 | Vogel et al. |
| 6,267,049 | B1 | 7/2001 | Silvano |
| 6,301,918 | B1 | 10/2001 | Quartaron et al. |
| 6,370,892 | B1 | 4/2002 | Ross |
| 6,619,056 | B1 | 9/2003 | Midden et al. |
| 6,622,510 | B1 | 9/2003 | Giroux et al. |
| 6,679,314 | B1 | 1/2004 | Frank |
| 6,817,207 | B1 | 11/2004 | Bonato et al. |

* cited by examiner

CHILLED BEVERAGE DISPENSER WITH CRADLE EVAPORATOR

CROSS-REFERENCE TO RELATED APPLICATIONS

The present application claims priority to U.S. Provisional Patent Application Ser. No. 60/631,803 filed on Nov. 30, 2004, the entire disclosure of which is incorporated herein by reference.

BACKGROUND OF THE INVENTION

The present invention relates to beverage dispensers for cooling a beverage to an acceptable temperature for consumption. In this regard, there are various distinct types of chilled beverage dispensers in the industry. Each, however, requires some sort of cooling system, typically a source of a cooling medium, such as a compressor and pump, a heat exchanger, and connecting tubing between the heat exchanger and cooling medium source. The heat exchanger itself is generally in contact with the beverage or the bowl containing the beverage. For example, one common type of dispenser incorporates a heat exchanger consisting of one or more continuous sinuous tubes submerged within the beverage in the dispenser bowl. The tubes form a heat exchanger bank that carries the cooling medium. The beverage is caused to circulate about the bank, allowing its heat to be transferred across the walls of the tubing to the flowing cooling medium. However, in such a dispenser, there must be a hole or opening through the bottom wall of the dispenser bowl to allow the tubes submerged in the beverage to be in fluid communication with the compressor and pump. Furthermore, such a construction creates a sanitation problem as the internal surfaces of the bowls and the heat exchanger bank must be cleaned with regularity, and the very shape of the heat exchanger bank poses a significant challenge to cleaning.

Therefore, alternative dispenser constructions have attempted to avoid the sanitation problem by creating a "holeless" dispenser bowl, in which the heat exchanger abuts an external surface of the bowl, commonly, the bottom wall of the bowl. Accordingly, the bottom wall of the bowl acts as an intermediary heat conductor and transfers the heat from the beverage to the flowing cooling medium of the heat exchanger. However, this is often an ineffective or inefficient cooling technique.

Thus, there remains a need for chilled beverage dispenser that avoid sanitation problems of the prior art, but without sacrificing the effectiveness and efficiency of the cooling of the beverage.

SUMMARY OF THE INVENTION

The present invention is a chilled beverage dispenser that has a "holeless" bowl and uses a cradle evaporator to achieve cooling of the beverage. An exemplary chilled beverage dispenser made in accordance with the present invention can generally be characterized as having an upper portion and a lower portion. The upper portion has a support chassis, which includes walls that collectively define a compartment for housing a dispenser bowl and a cradle evaporator. The lower portion includes a frame that defines a compartment for housing various cooling components for providing the necessary cooling medium to the cradle evaporator.

The cradle evaporator comprises three panels—a bottom panel and two side panels, the side panels being bolted or similarly fastened to the edges of the bottom panel in a substantially perpendicular orientation relative to the bottom panel, recognizing that there may be a slight draft or taper to accommodate insertion and removal of the dispenser bowl. The bottom and side panels each define a continuous and sinuous channel, which carries a cooling medium. For example, the panels may be constructed of die-cast aluminum with cast-in copper evaporator coils.

The dispenser bowl preferably is constructed of a thin-walled plastic, such that heat transfer can be achieved through the bottom and side walls of the dispenser bowl. Specifically, the bottom panel of the cradle evaporator has substantially the same size and shape and is co-extensive with the bottom wall of the dispenser bowl. Furthermore, the side panels are in contact with the side walls of the dispenser bowl over a substantial portion of the surface of each side wall.

As the cooling medium enters the cradle evaporator, it first enters the continuous and sinuous channel of the bottom panel, such that initial heat absorption is through the bottom wall of the dispenser bowl. As it completes travel through the channel of the bottom panel, the path of the cooling medium is split and directed to each of the continuous and sinuous channels of the side panels. This provides for the absorption of heat along the side walls of the dispenser bowl. Accordingly, the aforementioned sanitation problems are addressed as there is a "holeless" dispenser bowl, which can readily be lifted away from the remainder of the dispenser for cleaning. At the same time, there is no sacrifice of the effectiveness and efficiency of the cooling of the beverage because heat transfer occurs not only through the bottom wall of the dispenser bowl, but also through portions of the side walls of the dispenser bowl.

Furthermore, it is also contemplated that the cradle evaporator could have an alternative shape generally corresponding to that of the dispenser bowl, recognizing that the cradle evaporator will function as intended as long as heat transfer occurs not only through the bottom wall of the dispenser bowl, but also through portions of the side walls of the dispenser bowl.

DETAILED DESCRIPTION OF THE INVENTION

Figure 1:
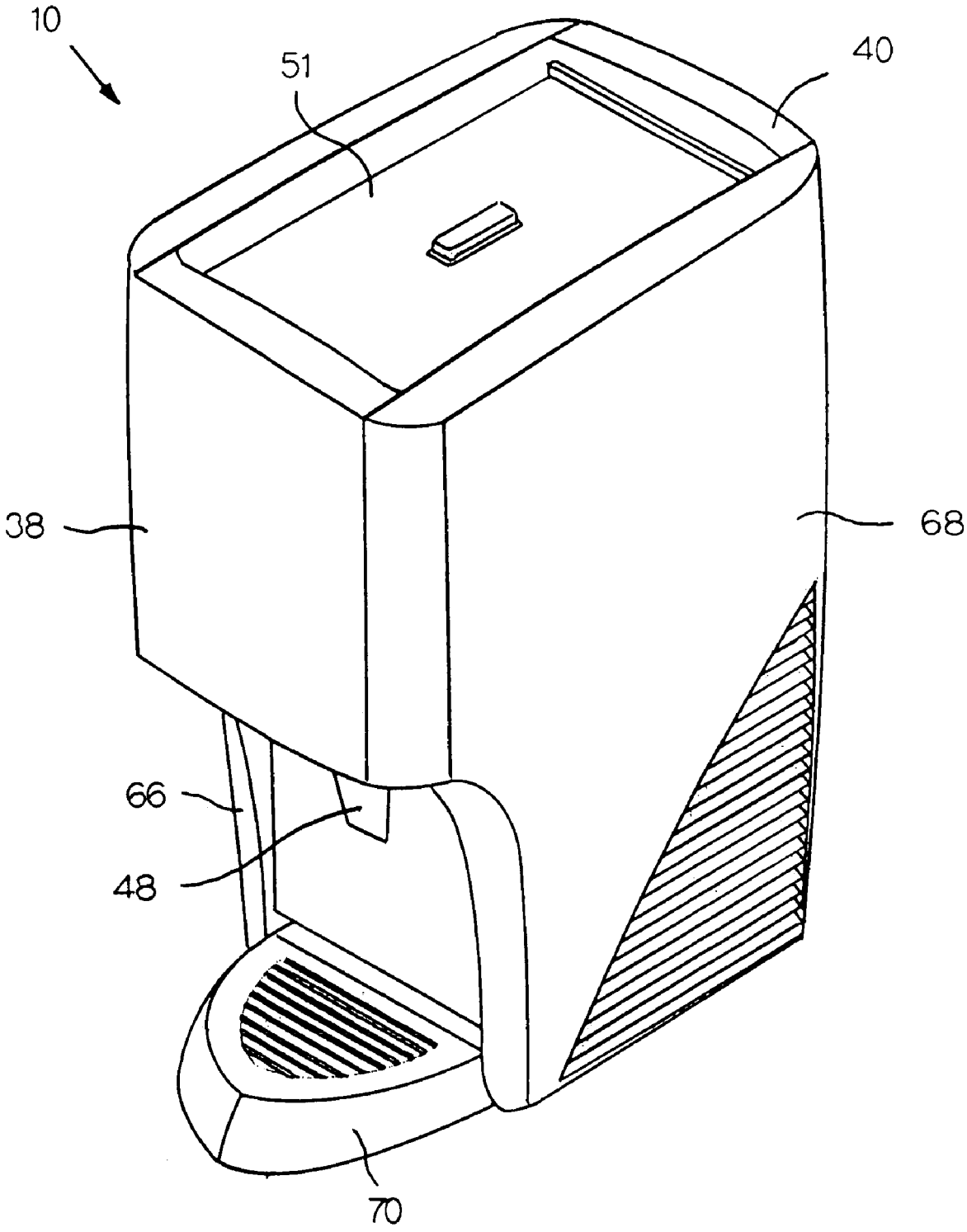
FIG. 1 is a perspective view of an exemplary chilled beverage dispenser made in accordance with the present invention.
Figure 2:
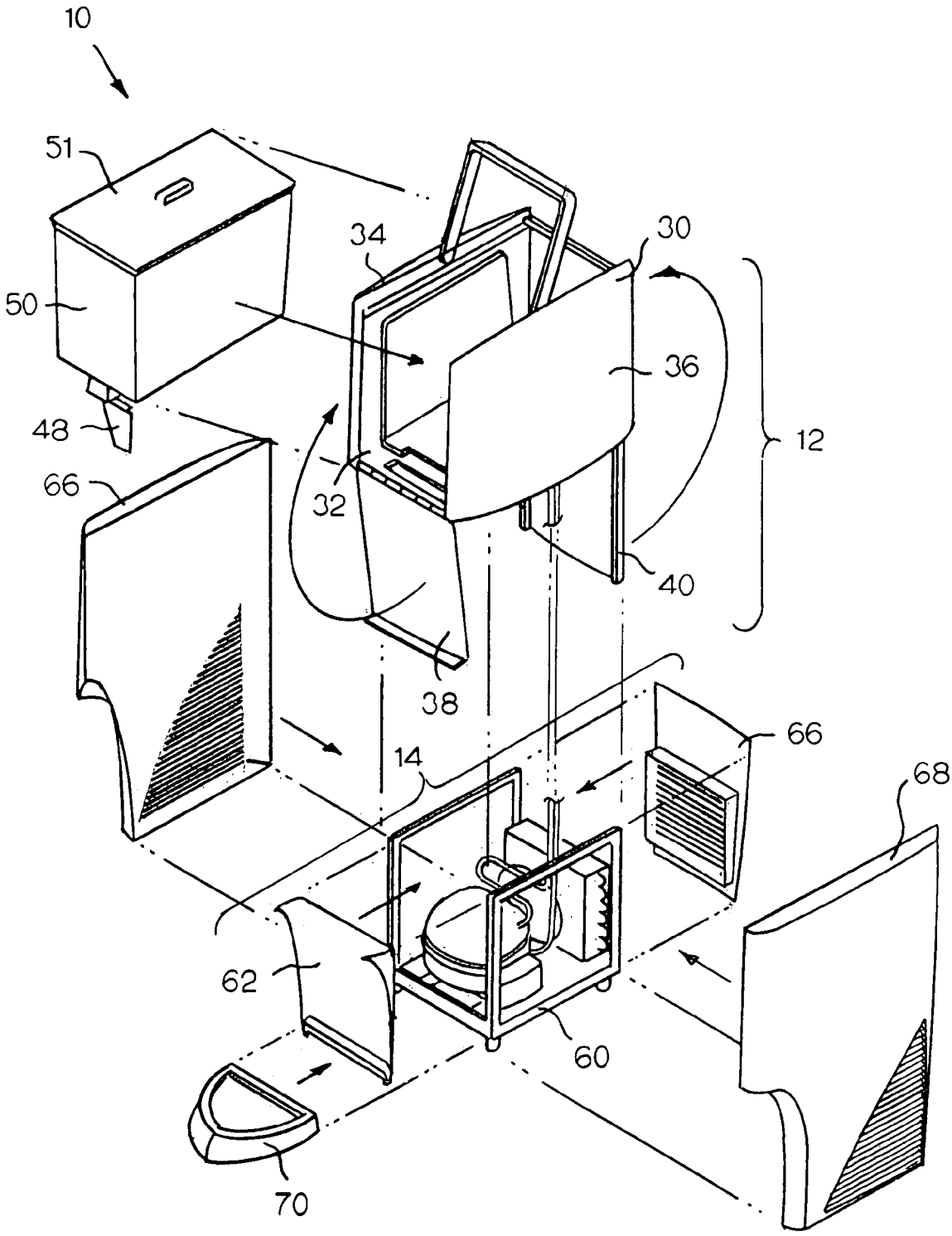
FIG. 2 is an exploded perspective view of the exemplary chilled beverage dispenser of FIG. 1.

The present invention is a chilled beverage dispenser that has a "holeless" bowl and uses a cradle evaporator to achieve cooling of the beverage FIGS. 1 and 2 are perspective and exploded perspective views of an exemplary chilled beverage dispenser 10 made in accordance with the present invention. As best illustrated in FIG. 2, the dispenser 10 can generally be characterized as having an upper portion 12 and a lower portion 14. The upper portion 12 includes a support chassis 30, which has a bottom wall 32; left and right side walls 34, 36; and front and rear walls 38, 40, which in this exemplary embodiment, are hinged to and pivot relative to the bottom wall 32. These walls 32, 34, 36, 38, 40 collectively define a compartment for housing a dispenser bowl 50 (which, in this exemplary embodiment, includes an open top covered by a lid 51) and a cradle evaporator 52. The lower portion 14 includes a frame 60 that defines a compartment for housing various cooling components for providing the necessary cooling medium to the cradle evaporator 52, as further described below.

The bottom wall 32 of the support chassis 30 is secured to and supported on the top portion of the frame 60. Then, and referring still to FIG. 2, various external housing panels are secured to the support chassis 30 and the frame 60 to complete assembly of the exemplary chilled beverage dispenser 10. As illustrated in FIG. 2, in this exemplary embodiment, there are front and rear panels 62, 64 that are secured to the frame 60 along the lower portion of the dispenser 10, along with side panels 66, 68 that are secured to the support chassis 30 and the frame 60 that span the height of the dispenser 10. Furthermore, in this exemplary embodiment, there is a drain tray 70 secured to the front of the panel, and a cup or similar receptacle (not shown) is placed on this drain tray 70 to receive a dispensed beverage.

Figure 3:
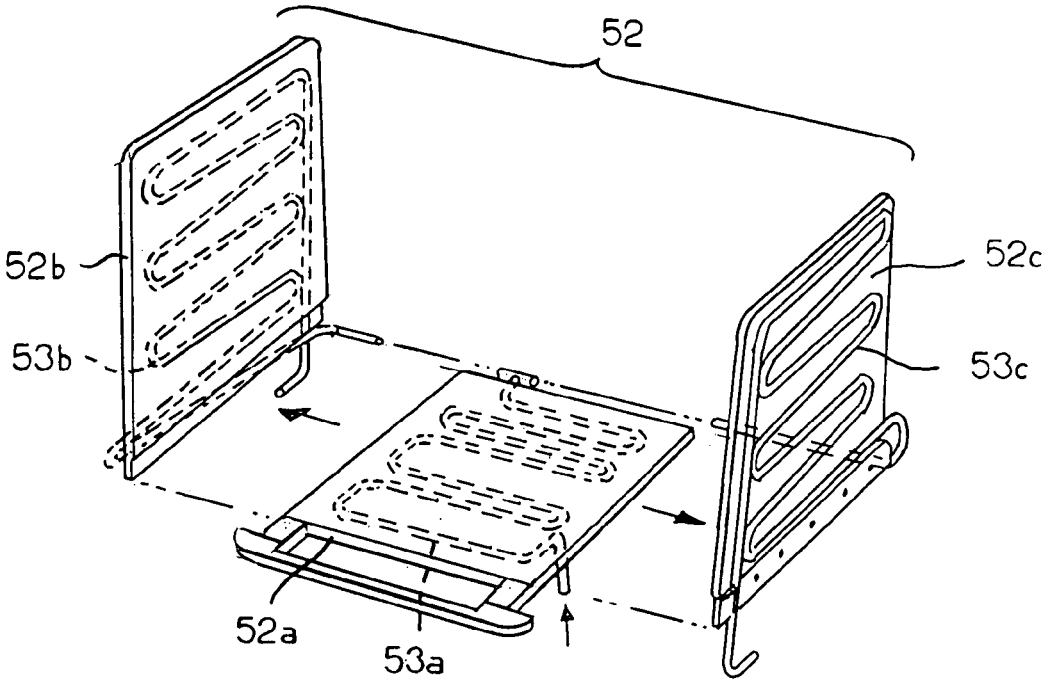
FIG. 3 is an exploded perspective view of the three panels that comprise the cradle evaporator of the exemplary chilled beverage dispenser of FIG. 1.
Figure 4:
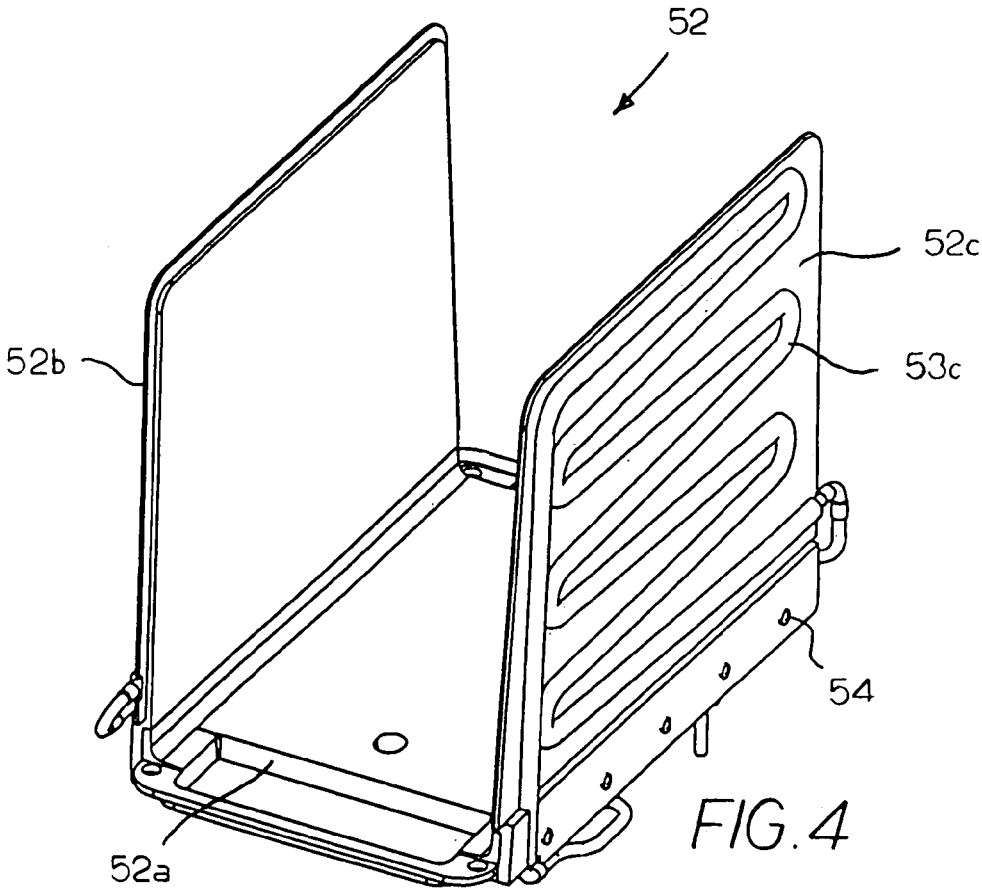
FIG. 4 is an assembled perspective view of the cradle evaporator of the exemplary chilled beverage dispenser of FIG. 1.

In any event, the focus of the present invention is on the cooling of the dispenser bowl 50, which is accomplished through the use of the cradle evaporator 52. Referring now to FIGS. 3 and 4, in this exemplary embodiment, the cradle evaporator 52 comprises three panels- a bottom panel 52*a* and two side panels 52*b*, 52*c*. The side panels 52*b*, 52*c* are bolted or similarly fastened to the edges of the bottom panel 52*a*, such that the side panels 52*b*, 52*c* are in a substantially perpendicular orientation relative to the bottom panel 52*a*, recognizing that there may be a slight draft or taper to accommodate insertion and removal of the dispenser bowl 50. These side panels 52*b*, 52*c* are secured to the bottom panel 52 by using screws 54 or similar fasteners. More importantly, the bottom and side panels 52*a*, 52*b*, 52*c* each define a continuous and sinuous channel 53*a*, 53*b*, 53*c*, such channels receiving and defining a pathway for movement of the cooling medium, as is further described below. Furthermore, the channels 53*a*, 53*b*, 53*c* of the panels 52*a*, 52*b*, 52*c* are in fluid communication with one another. In any event, in this exemplary embodiment, the panels 52*a*, 52*b*, 52*c* are constructed of die-cast aluminum with cast-in copper evaporator coils 53*a*, 53*b*, 53*c*.

It should also be recognized that although the cradle evaporator 52 described above is constructed of three discrete panels 52*a*, 52*b*, 52*c*, it could alternatively have a unitary structure. For example, the cradle evaporator 52 could be fabricated as a one-piece die casting. Furthermore, although the cradle evaporator 52 described above has cast-in copper evaporator coils 53*a*, 53*b*, 53*c*, it is contemplated that a roll-bonded evaporator comprised of two sheets of metal joined and formed into the appropriate "cradle" shape could be used without departing from the spirit and scope of the present invention.

Figure 5:
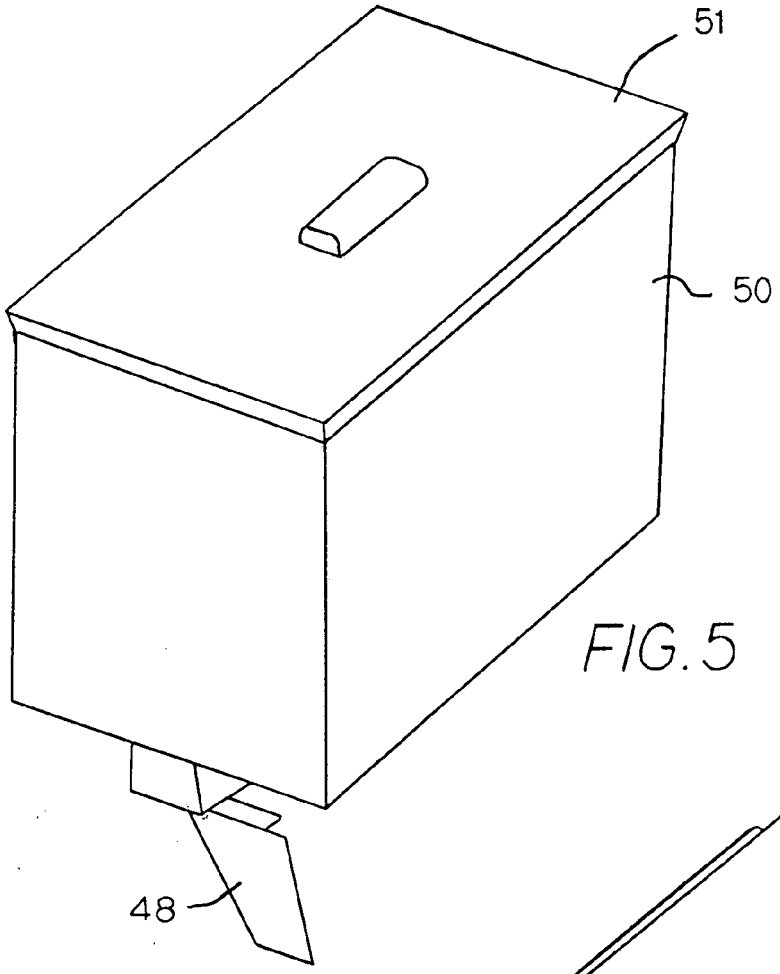
FIG. 5 is a perspective view of the dispenser bowl of the exemplary chilled beverage dispenser of FIG. 1.

FIG. 5 is a perspective view of the dispenser bowl 50 of the exemplary chilled beverage dispenser 10, which, as mentioned above, has a "holeless" construction with no holes or openings through the bottom wall of the bowl 50, aside, of course, from an opening necessary for the dispensing function. Indeed, and as illustrated, the exemplary dispenser bowl 50 includes a dispensing handle and valve assembly 48, which allow a user to dispense the beverage from the dispenser bowl 50 into a cup or similar receptacle. Such a dispensing handle and valve assembly 48 is well known to one of ordinary skill in the art. Furthermore, although not illustrated in the Figures, it will be recognized and understood by one of ordinary skill in the art that various types of impellers or whipper assemblies may be positioned in the dispenser bowl 50 without departing from the spirit and scope of the present invention. Finally, and more importantly, the dispenser bowl 50 preferably is constructed of a thin-walled plastic; for example, in this exemplary embodiment, the dispenser bowl 50 is constructed of polycarbonate and has a nominal wall thickness of 1/16". Applicants have found such a material and thickness to provide an appropriate balance of durability versus heat transfer capabilities, but of course, it is contemplated that various other plastics may be used to construct the dispense bowl without departing from the spirit and scope of the present invention.

Figure 6:
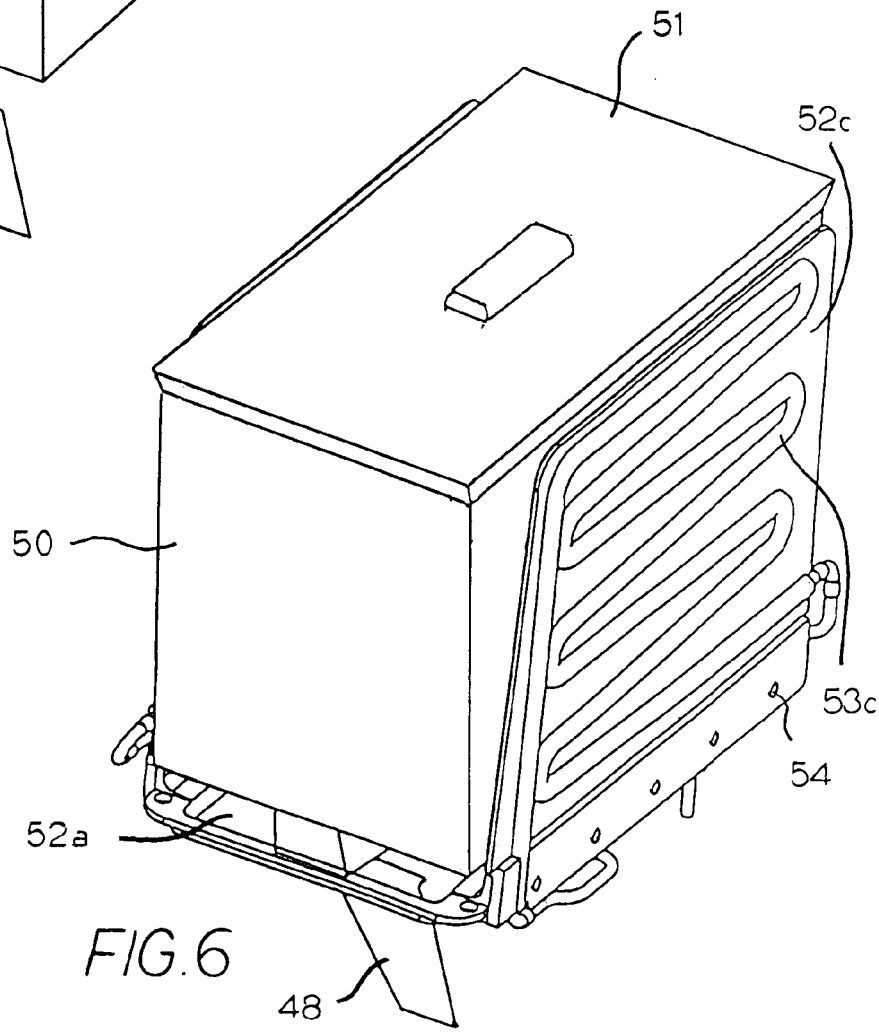
FIG. 6 is a perspective view of the dispenser bowl received in the cradle evaporator of the exemplary chilled beverage dispenser of FIG. 1.

Referring now to FIG. 6, the bottom panel 52*a* of the cradle evaporator 52 has substantially the same size and shape and is co-extensive with the bottom wall of the dispenser bowl 50. Similarly, the side panels 52*b*, 52*c* are in contact with the side walls of the dispenser bowl 50 over a portion of the surface of each side wall. Nevertheless, it is not necessary for the bottom wall or side walls of the dispenser bowl 50 to be "covered" in order to achieve the objectives of the present invention. Finally, it is noteworthy that the weight of the beverage in the dispenser bowl 50 tends to press the walls against the cradle evaporator 52 to improve heat transfer efficiencies.

With respect to the positioning of the dispenser bowl 50 in the cradle evaporator 52, this assembly is then received and retained in the support chassis 30, as described above with respect to FIG. 1. Accordingly, the walls 32, 34, 36, 38, 40 of the support chassis 30 insulate the cradle evaporator 52 and the dispenser bowl 50 from ambient conditions, thus minimizing typical heat gain from the surrounding environment and also minimizing cooling capacity heat losses due to condensation on the walls of the dispenser bowl 50, as well as radiated heat losses. In this regard, as a further refinement, the support chassis 30 may be foamed with frothed urethane insulation.

Furthermore, although not illustrated in the accompanying Figures, it is contemplated that, in certain embodiments, the front and rear walls 38, 40 of the support chassis 30 could be eliminated, but that adequate efficiency could still be achieved through the insulating effect of the bottom and side walls 32, 34, 46.

Figure 7:
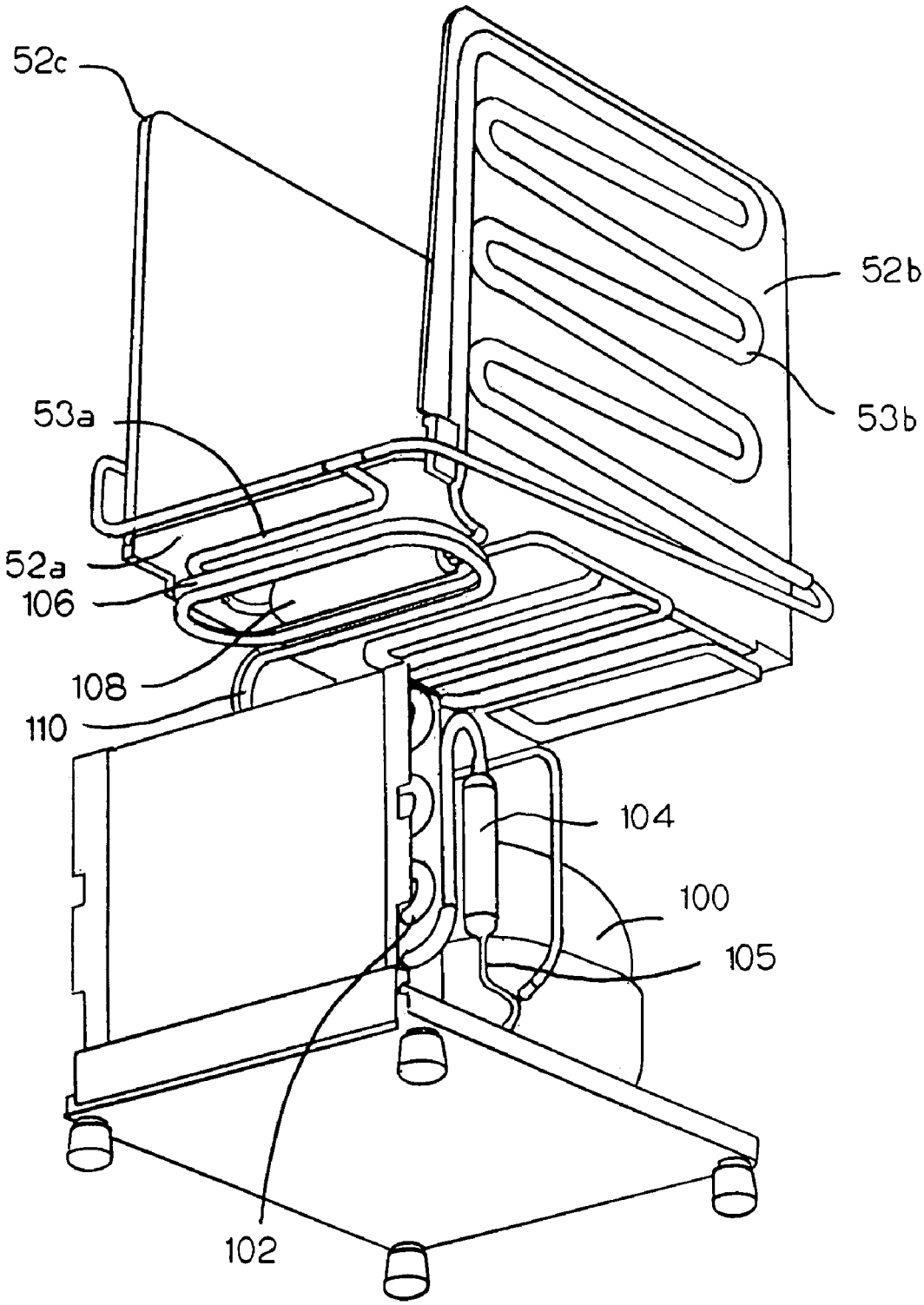
FIG. 7 is a partial perspective view of the exemplary chilled beverage dispenser of FIG. 1, illustrating the fluid connection of the cradle evaporator to the cooling components housed in the lower portion of the exemplary chilled beverage dispenser of FIG. 1.
Figure 8:
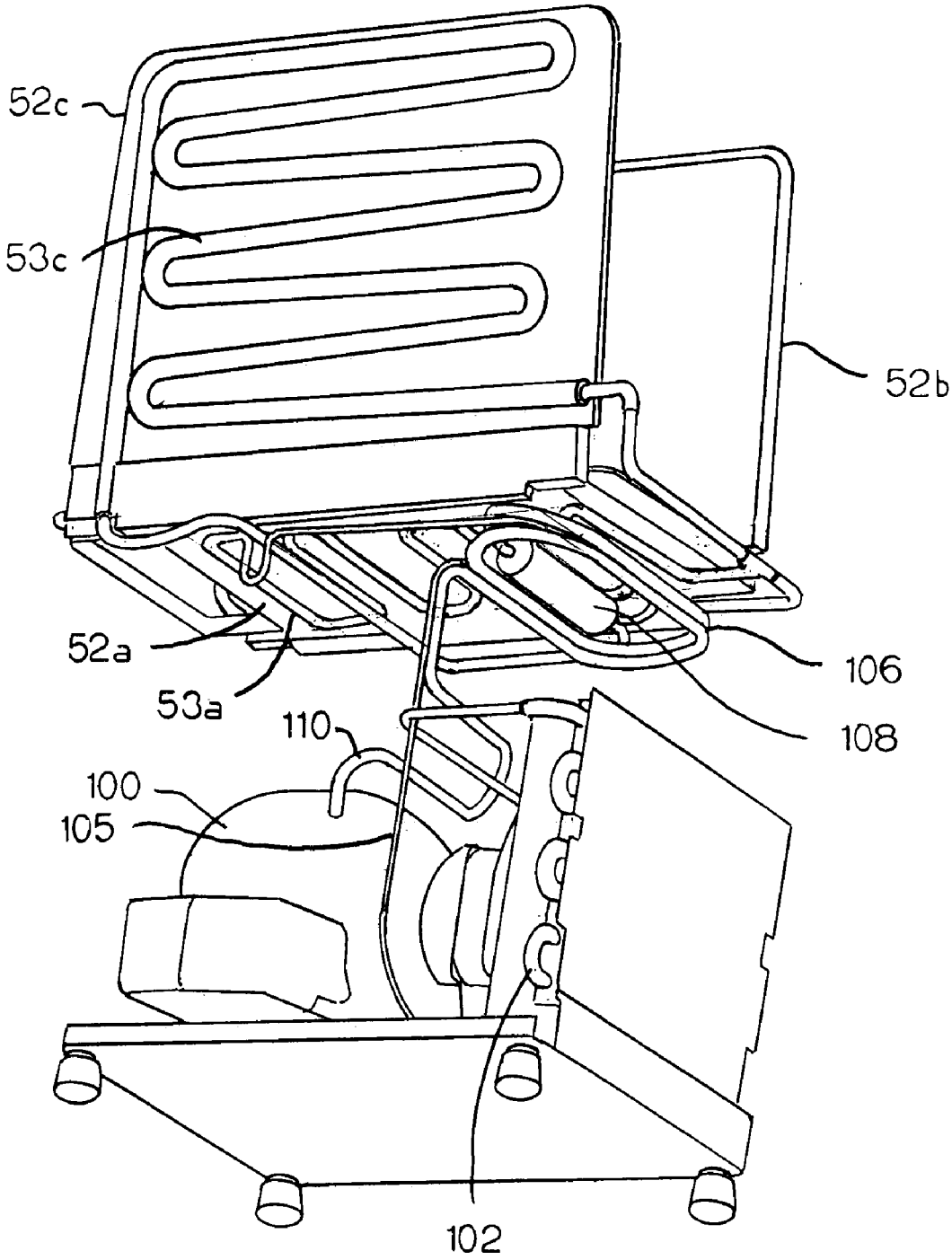
FIG. 8 is another partial perspective view of the exemplary chilled beverage dispenser of FIG. 1, illustrating the fluid connection of the cradle evaporator to the cooling components housed in the lower portion of the exemplary chilled beverage dispenser of FIG. 1.
Figure 9:
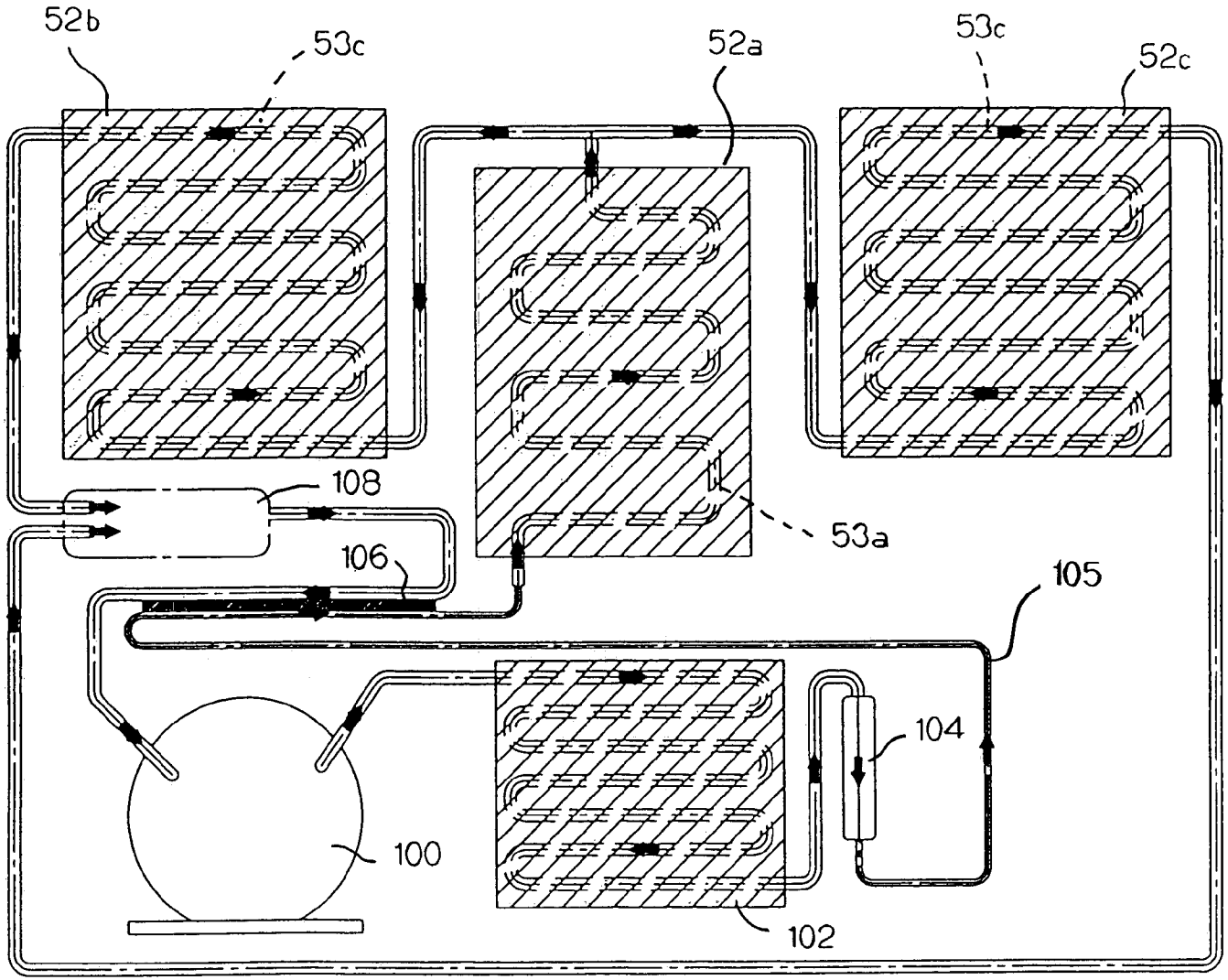
FIG. 9 is a schematic view of the flow path for the cooling medium in the exemplary chilled beverage dispenser of FIG. 1.

Referring now to FIGS. 7 and 8, the cradle evaporator 52 is in fluid communication with the cooling components housed in the lower portion 14 of the dispenser 10. Specifically, the cooling components in this exemplary embodiment include a compressor 100, condenser 102, a filter/dryer 104, a capillary tube 105, a heat exchanger 106, a suction accumulator 108, and a suction line 110. As is common in such cooling systems, the compressor 100 compresses the cooling medium, preferably a refrigerant gas such as R134a (a commercially available hydrofluorocarbon refrigerant), to raise the temperature and stored energy of the cooling medium. Therefore, the cooling medium exits the compressor 100 and enters the condenser 102 as a hot, high pressure gas. In the condenser 102, the heat from the pressurization of the cooling medium is dissipated, and the cooling medium reverts to a liquid form, but remains at a high pressure. The cooling medium then passes through a filter drier 104, which is designed to filter out contaminants and dry the cooling medium to prevent ice formation. As it exits the filter drier 104, the cooling medium passes through a capillary tube 105, which serves as a pressure-reducing device and meters the cooling medium into the cradle evaporator 52. Because of the pressure drop, the cooling medium evaporates, absorbing heat as it do so. By the time the cooling medium exits the evaporator 52, returning to the compressor 100 through a suction accumulator 108 and associated suction line 110, it again is a cool, low-pressure gas.

Referring still to FIG. 8, as the cooling medium enters the cradle evaporator 52, it first enters the continuous and sinuous channel 53*a* of the bottom panel 52*a*, such that initial heat absorption is through the bottom wall of the dispenser bowl 50. As it completes travel through the channel 53*a* of the bottom panel 52*a*, the path of the cooling medium is split and directed to each of the continuous and sinuous channels 53*b*, 53*c* of the side panels 52*b*, 52*c*. This provides for the absorption of heat along the side walls of the dispenser bowl 50. Finally, the cooling medium exits the side panels 52*b*, 52*c* and returns to the compressor 100 through the suction accumulator 108, as mentioned above.

As a further refinement, in the exemplary embodiment illustrated in FIG. 8, the cooling system includes a heat exchanger 106 at a solder joint between the suction line 110 and the capillary tube 105. Accordingly, there is a sub cooling of the cooling medium prior to entering the cradle evaporator 52, which improves the efficiency of the cooling system and also prevents flash gas from forming inside of the capillary tube 105.

Although the above description provides an example of an appropriate cooling system for the present invention, it should be recognized and understood and various cooling systems and/or techniques could be used to provide the necessary cooling medium to the cradle evaporator 52 without departing from the spirit and scope of the present invention.

In any event, the exemplary chilled beverage dispenser 10 described above addresses the aforementioned sanitation problems as it includes a "holeless" dispenser bowl 50, which can readily be lifted away from the remainder of the dispenser 10 for cleaning. At the same time, there is no sacrifice of the effectiveness and efficiency of the cooling of the beverage because heat transfer occurs not only through the bottom wall of the dispenser bowl 50, but also through portions of the side walls of the dispenser bowl. Specifically, it is recognized that the interposition of the walls of the dispenser bowl 50 between the evaporator 52 and the beverage results in some heat transfer inefficiencies as compared to a placement of a heat exchanger in the dispenser bowl and in direct contact with a beverage. However, any such inefficiencies are offset by the substantially larger surface area over which heat transfer takes place (i.e., the bottom and side walls of the dispenser bowl 50). Furthermore, and as mentioned above, the walls 32, 34, 36, 38, 40 of the support chassis 30 insulate the cradle evaporator 52 and the dispenser bowl 50 from ambient conditions, thus minimizing typical heat gain from the surrounding environment and also minimizing cooling capacity heat losses due to condensation on the walls of the dispenser bowl 50, as well as radiated heat losses.

It should also be recognized that although the channels 53*b*, 53*c* in the side panels 52*b*, 52*c* of the cradle evaporator 52 substantially cover the external surfaces of the panels 52*b*, 52*c*, such complete coverage not critical. It is contemplated that the channels 53*b*, 53*c* could extend along only a portion of each side panel 52*b*, 52*c*. Furthermore, it is contemplated that there could be no channels extending up the side panels 52*b*, 52*c*, but rather, the cooling of the side panels 52*b*, 52*c*, and thus the side walls of the dispenser bowl 50, would be achieved through conduction from the bottom panel 52*a* to the side panels 52*b*, 52*c*, especially when the cradle evaporator 52 has a unitary structure, such as the one-piece die casting mentioned above.

Although not illustrated in the Figures, it is also contemplated that the cradle evaporator could have an alternative shape if the dispenser bowl has a non-rectangular shape. For example, if the dispenser bowl was designed with a generally cylindrical shape, the cradle evaporator may be designed with a bottom wall and a single continuous side wall to effectuate cooling of the beverage within the dispenser bowl. For another example, if the dispenser bowl had a triangular shape, the cradle evaporator could be designed with a bottom wall and two non-parallel side walls adjacent two sides of the dispenser bowl, while the third side remained unobstructed for viewing of the beverage. In short, regardless of the specific shape, the cradle evaporator will function as intended as long as heat transfer occurs not only through the bottom wall of the dispenser bowl, but also through portions of the side walls of the dispenser bowl.

One of ordinary skill in the art will recognize that additional embodiments are possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A chilled beverage dispenser, comprising:

a bowl for receiving and storing a beverage, said bowl having a bottom wall and one or more side walls;

a means for supplying a cooling medium to chill the beverage when stored in said bowl;

an evaporator including one or more channels for receiving and defining a pathway for movement of the cooling medium, said evaporator receiving and cradling the bowl such that heat transfer is achieved through at least the bottom wall and portions of the one or more side walls of the bowl; and a support chassis defining a compartment for receiving and supporting said bowl and said evaporator, wherein said bowl can be readily lifted out of said compartment and away from said support chassis and said evaporator for cleaning.

2. The chilled beverage dispenser as recited in claim 1, in which the bowl has a generally rectangular shape, including the bottom wall, two opposing side walls, a front wall, and a rear wall.

3. The chilled beverage dispenser as recited in claim 2, wherein said evaporator comprises a bottom panel and two side panels, with the said side panels secured to the bottom panel in a substantially perpendicular orientation relative to the bottom panel, thus defining a cradle adapted to receive and retain the bowl.

4. The chilled beverage dispenser as recited in claim 3, in which each panel includes a channel defining a pathway for movement of the cooling medium, with the channel of the bottom panel being in fluid communication with the respective channels of the two side panels.

5. The chilled beverage dispenser as recited in claim 4, in which the cooling medium first enters the channel of the bottom panel, and then, after completing travel through the channel of the bottom panel, is directed to each of the channels of the respective side panels.

6. The chilled beverage dispenser as recited in claim 3, in which the support chassis includes left and right side walls corresponding and adjacent to the opposing side panels of the evaporator, and a bottom wall corresponding and adjacent to the bottom panel of the evaporator.

7. The chilled beverage dispenser as recited in claim 6, in which the walls of the support chassis are foamed with frothed urethane insulation.

8. The chilled beverage dispenser as recited in claim 6, in which the support chassis further includes front and rear walls.

9. The chilled beverage dispenser as recited in claim 8, in which the walls of the support chassis are foamed with frothed urethane insulation.

10. The chilled beverage dispenser as recited in claim 3, which the panels are constructed of die-cast aluminum with cast-in copper evaporator coils serving as the channels for receiving and defining a pathway for movement of the cooling medium.

11. The chilled beverage dispenser as recited in claim 1, in which the bowl is constructed of a thin-walled plastic.

12. The chilled beverage dispenser as recited in claim 11, in which the thin-walled plastic is polycarbonate.

13. The chilled beverage dispenser as recited in claim 11, in which the bowl has a nominal wall thickness of 1/16".

14. A chilled beverage dispenser, comprising:

a bowl for receiving and storing a beverage, said bowl having a bottom wall and one or more side walls;

an evaporator including one or more channels for receiving and defining a pathway for movement of a cooling medium, said evaporator cradling the bowl such that heat transfer is achieved through at least the bottom wall and portions of the one or more side walls of the bowl;

a cooling system for supplying the cooling medium to the evaporator; and a support chassis defining a compartment for receiving and supporting said bowl and said evaporator, wherein said bowl can be readily lifted out of said compartment and away from said support chassis and said evaporator for cleaning.

15. The chilled beverage dispenser as recited in claim 14, in which the dispenser can be characterized as having an upper portion and a lower portion, the upper portion including the support chassis, and the lower portion defining a compartment for housing the cooling system.

16. The chilled beverage dispenser as recited in claim 14, wherein said evaporator comprises a bottom panel and two side panels, with said side panels being secured to the bottom panel in a substantially perpendicular orientation relative to the bottom panel, thus defining a cradle adapted to receive and cradle the bowl.

17. The chilled beverage dispenser as recited in claim 16, in which each panel includes a channel defining a pathway for movement of the cooling medium, with the channel of the bottom panel being in fluid communication with the respective channels of the two side panels.

18. The chilled beverage dispenser as recited in claim 17, in which the cooling medium first enters the channel of the bottom panel, and then, after completing travel through the channel of the bottom panel, is directed to each of the channels of the respective side panels.

* * * * *